US009267183B2

(12) United States Patent
Kochi et al.

(10) Patent No.: US 9,267,183 B2
(45) Date of Patent: Feb. 23, 2016

(54) WIRE WITH EXCELLENT SUITABILITY FOR DRAWING AND PROCESS FOR PRODUCING THE SAME

(75) Inventors: Takuya Kochi, Kobe (JP); Shogo Murakami, Kobe (JP); Shoji Miyazaki, Kobe (JP); Ken Ishida, Kobe (JP); Masao Toyama, Kobe (JP); Fujio Koizumi, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 901 days.

(21) Appl. No.: 12/279,000

(22) PCT Filed: Nov. 7, 2006

(86) PCT No.: PCT/JP2006/322130

§ 371 (c)(1),
(2), (4) Date: Aug. 11, 2008

(87) PCT Pub. No.: WO2007/099671

PCT Pub. Date: Sep. 7, 2007

(65) Prior Publication Data

US 2009/0007998 A1 Jan. 8, 2009

(30) Foreign Application Priority Data

Feb. 28, 2006 (JP) ..... 2006-053525

(51) Int. Cl.
*C21D 9/52* (2006.01)
*C21D 3/06* (2006.01)
(Continued)

(52) U.S. Cl.
CPC *C21D 3/06* (2013.01); *C21D 8/065* (2013.01); *C21D 9/525* (2013.01); *C22C 38/002* (2013.01);
(Continued)

(58) Field of Classification Search
USPC ..... 148/598
See application file for complete search history.

(56) References Cited

U.S. PATENT DOCUMENTS 2,798,018 A * 7/1957 Derge ..... 148/641
6,277,220 B1 * 8/2001 Hamada et al. ..... 148/595
(Continued)

FOREIGN PATENT DOCUMENTS

EP 1 013 780 A1 6/2000
EP 1 674 588 A1 6/2006
(Continued)

OTHER PUBLICATIONS

Office Action issued Sep. 16, 2010, in Korean Patent Application No. 10-2008-7020991 (with English-language translation).
(Continued)

*Primary Examiner* — Jessee Roe
*Assistant Examiner* — Christopher Kessler
(74) *Attorney, Agent, or Firm* — Oblon, McClelland, Maier & Neustadt, L.L.P

(57) ABSTRACT

A hot-rolled wire rod excelling in wire drawability is provided, in which breakage can be suppressed even in heavy work from a large diameter. A hot-rolled wire rod contains C: 0.35 to 0.65% (percent by mass, hereinafter expressed as well), Si: 1.4 to 3.0%, Mn: 0.10 to 1.0%, Cr: 0.1 to 2.0%, P: 0.025% or less (exclusive of 0%), S: 0.025% or less (exclusive of 0%), N: 0.006% or less (exclusive of 0%), Al: 0.1% or less (exclusive of 0%), and O: 0.0030% or less (exclusive of 0%), with the remnant consisting of Fe and inevitable impurities; wherein the content of hydrogen in steel is 2.50 ppm (ppm by mass, hereinafter expressed as well) or less, and hardness (HV) is $460\times C_0^{0.1}$ or less ($C_0$ indicates the content of C (percent by mass) in a position of depth of D/4 (D: diameter of the wire rod)).

11 Claims, 1 Drawing Sheet

(51) Int. Cl.

| | |
|---|---|
| ***C21D 8/06*** | (2006.01) |
| ***C22C 38/00*** | (2006.01) |
| ***C22C 38/04*** | (2006.01) |
| ***C22C 38/20*** | (2006.01) |
| ***C22C 38/28*** | (2006.01) |
| ***C22C 38/34*** | (2006.01) |
| ***C22C 38/42*** | (2006.01) |
| ***C22C 38/50*** | (2006.01) |
| *B21B 1/16* | (2006.01) |
| *B21B 3/00* | (2006.01) |

(52) U.S. Cl.

CPC ..... *C22C 38/04* (2013.01); *C22C 38/20* (2013.01); *C22C 38/28* (2013.01); *C22C 38/34* (2013.01); *C22C 38/42* (2013.01); *C22C 38/50* (2013.01); *B21B 1/16* (2013.01); *B21B 3/00* (2013.01)

(56) References Cited

U.S. PATENT DOCUMENTS

| | | | | |
|---|---|---|---|---|
| 6,372,056 | B1 | 4/2002 | Kuroda et al. | |
| 2006/0196584 | A1* | 9/2006 | Kochi et al. ..... | 148/332 |

FOREIGN PATENT DOCUMENTS

| | | |
|---|---|---|
| JP | 1 222069 | 9/1989 |
| JP | 2 57637 | 2/1990 |
| JP | 9-87739 | 3/1997 |
| JP | 10-1746 A | 1/1998 |
| JP | 11 199977 | 7/1999 |
| JP | 11-302729 | 11/1999 |
| JP | 2000 239797 | 9/2000 |
| JP | 2003 253391 | 9/2003 |
| JP | 2004 2994 | 1/2004 |
| JP | 2004 137597 | 5/2004 |
| KR | 1993-0005075 | 6/1993 |

OTHER PUBLICATIONS

Canadian Office Action issued on Jan. 14, 2011 in corresponding Canadian Application No. 2,642,935.

U.S. Appl. No. 12/466,865, filed May 15, 2009, Kochi, et al.

U.S. Appl. No. 12/192,437, filed Aug. 15, 2008, Kochi, et al.

Office Action issued Mar. 22, 2013 in Indian Patent Application No. 4451/CHENP/2008.

Combined Brazilian Office Action and Search Report Issued Apr. 24, 2013 in Patent Application No. PI0621472-0 (with summarized English translations).

* cited by examiner

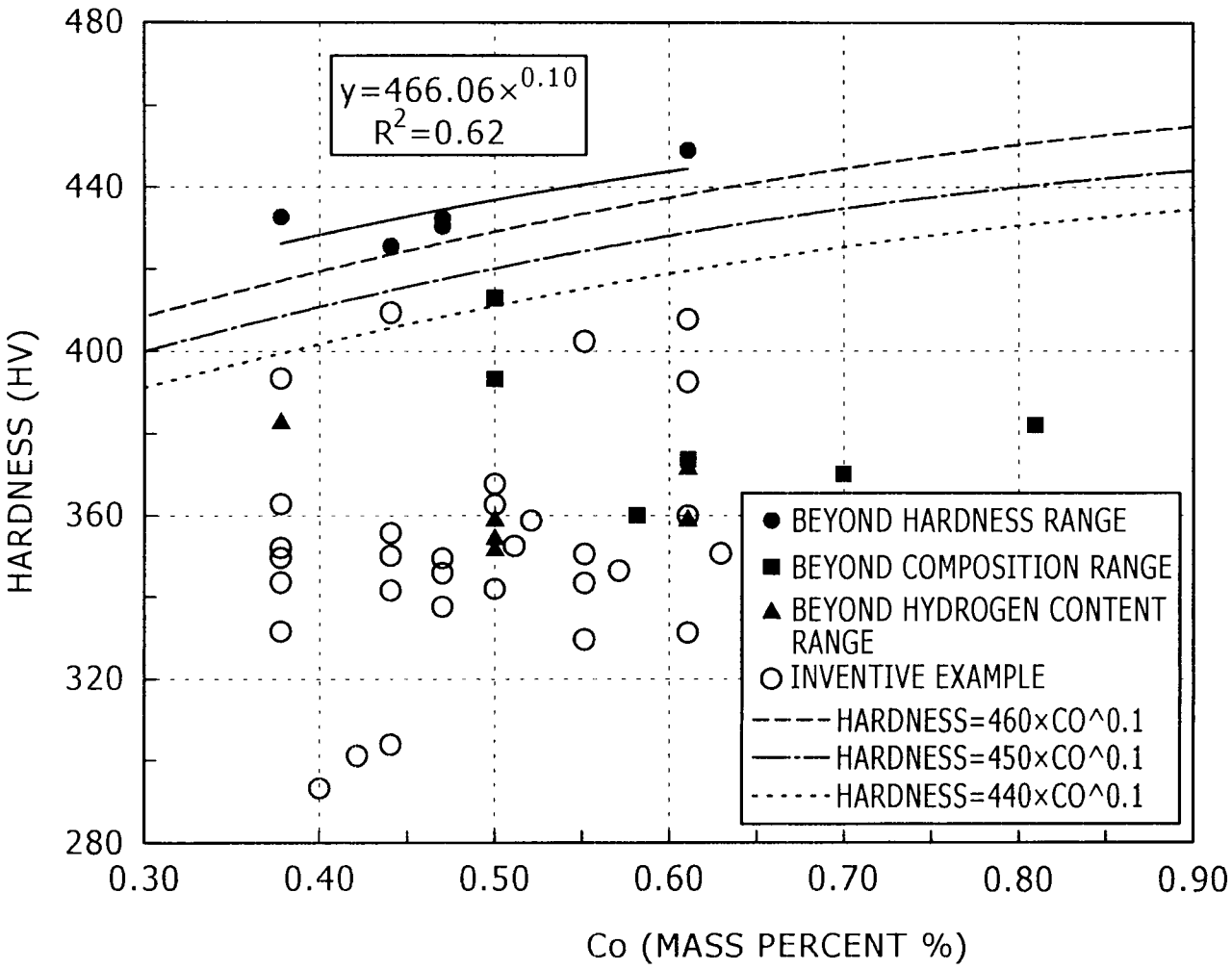
y=466.06×^0.10
R^2=0.62
BEYOND HARDNESS RANGE
BEYOND COMPOSITION RANGE
BEYOND HYDROGEN CONTENT RANGE
INVENTIVE EXAMPLE
HARDNESS=460×CO^0.1
HARDNESS=450×CO^0.1
HARDNESS=440×CO^0.1
HARDNESS (HV)
480
440
400
360
320
280
0.30
0.40
0.50
0.60
0.70
0.80
0.90
Co (MASS PERCENT %)

WIRE WITH EXCELLENT SUITABILITY FOR DRAWING AND PROCESS FOR PRODUCING THE SAME

TECHNICAL FIELD

The present invention relates to wire rods that can be used for materials of wire-drawing products such as steel cords, bead wire, PC steel wire, and spring steel, and a method of manufacturing the wire rods; and particularly relates to hot-rolled wire rods excelling in wire drawability, in which breakage can be suppressed even in heavy wire drawing of wire rods having large diameters, and a manufacturing method of the wire rods.

BACKGROUND ART

In the wire rods or the spring steel for wire drawing, wire drawability has been improved by controlling microstructural factors, suppressing segregation, or the like. For example, JP-A-11-199977 proposes that pearlite nodule size, a center segregation level, and a lamellar interval of a pearlite structure are controlled in order to improve wire drawability (particularly, rod drawability) of wire rods. JP-A-2000-239797 proposes that mechanical properties of spring steel are appropriately adjusted to improve rod drawability of the spring steel.

For high alloy formation associated with increase in strength of a spring and the like, suppression of supercooled microstructures is also required for the wire rods. Suppression of the supercooled microstructures can be achieved by manufacturing a wire rod having a large wire diameter. However, the wire rod having the large wire diameter exhibits large work hardening due to heavy wire drawing, and furthermore as initial wire diameter is increased, the wire drawing becomes more difficult. Therefore, a wire rod having a large diameter is required to have higher wire drawability.

DISCLOSURE OF THE INVENTION

Problem to be Solved by the Invention

It is desirable to provide a hot-rolled wire rod excelling in wire drawability, in which breakage can be suppressed even in heavy work using a wire rod with a large diameter.

Means for Solving the Problem

A hot-rolled wire rod according to an embodiment of the invention contains C: 0.35 to 0.65% (percent by mass, hereinafter expressed as well), Si: 1.4 to 3.0%, Mn: 0.10 to 1.0%, Cr: 0.1 to 2.0%, P: 0.025% or less (exclusive of 0%), S: 0.025% or less (exclusive of 0%), N: 0.006% or less (exclusive of 0%), Al: 0.1% or less (exclusive of 0%), and O: 0.0030% or less (exclusive of 0%), with the remnant consisting of Fe and inevitable impurities; wherein the content of hydrogen in steel is 2.50 ppm (ppm by mass, hereinafter expressed as well) or less, and hardness (HV) is $460\times C_0^{0.1}$ or less ($C_0$ indicates the content of C (percent by mass) in a position of depth of D/4 (D: diameter of the wire rod)). The "hot-rolled wire rod" in the embodiment of the invention means an "as-hot-rolled wire rod".

As a more preferable aspect of the hot-rolled wire rod according to the embodiment of the invention, (I) a wire rod is given, the rod having average grain diameter ($D_{ave}$) of 20 μm or less, and maximum grain diameter ($D_{max}$) of 80 μm or less in a bcc-Fe grain of a metallographic structure, and/or a wire rod satisfying the following equation (1) is given;

$$C_{max}/C_0 \leq 1.20 \quad (1)$$

(wherein $C_{max}$ indicates the content of C (percent by mass) in a position of depth of D/2 (D: diameter of the wire rod)), and $C_0$ indicates the content of C (percent by mass) in the position of depth of D/4).

Effectively, the hot-rolled wire rod of the embodiment of the invention may further contain the following as necessary: (A) Ni: 1% or less (exclusive of 0%) and/or Cu: 1.0% or less (exclusive of 0%), (B) at least one element selected from a group including V: 0.30% or less (exclusive of 0%), Ti: 0.10% or less (exclusive of 0%), Nb: 0.1% or less (exclusive of 0%), and Zr: 0.10% or less (exclusive of 0%), (C) Mo: 1.0% or less (exclusive of 0%), (D) B: 50 ppm or less (exclusive of 0 ppm), and/or (E) at least one element selected from a group including Mg: 50 ppm or less (exclusive of 0 ppm), Ca: 50 ppm or less (exclusive of 0 ppm), and rare earth elements: 1.5 ppm or less (exclusive of 0 ppm); wherein properties of the wire rod are further improved depending on a kind of components to be contained.

A manufacturing method according to an embodiment of the invention is positioned as a useful method for manufacturing the hot-rolled wire rod having the described property, that is, excellent wire drawability. A first aspect of the manufacturing method of the embodiment of the invention includes: performing heating in which a billet satisfying requirement of the composition (except for the hydrogen content) is held at 500 to 730° C. for 60 min; heating the billet to 950 to 1250° C., and performing hot rolling of the billet to make a wire rod at rolling temperature (Tr) of 800° C. or more and finish rolling temperature (Tf) of 1150° C. or less; placing the hot-rolled wire rod on a cooling bed at coiling temperature (TL) of 1020° C. or less; and cooling the wire at an average cooling rate (CR2) of 5° C./sec or less from the coiling temperature (TL) to 500° C.

A second aspect of the manufacturing method of the embodiment of the invention includes: performing heating in which a billet satisfying requirement of the composition (except for the hydrogen content) is held at 500 to 730° C. for 60 min; heating the billet to 950 to 1250° C., and performing hot rolling of the billet to make a wire rod at rolling temperature (Tr) of 800° C. or more and finish rolling temperature (Tf) of 1150° C. or less; placing a hot-rolled wire rod on a cooling bed at coiling temperature (TL) of 1020° C. or less; and cooling the wire at an average cooling rate (CR1) of 2° C./sec or more from the coiling temperature (TL) to 730° C., and at an average cooling rate (CR2) of 5° C./sec or less from the coiling temperature (TL) to 500° C.

A third aspect of the manufacturing method of the embodiment of the invention includes: performing homogenizing treatment in which a billet satisfying requirement of the composition (except for the hydrogen content) is held at 1250 to 1350° C. for 60 min; performing heating in which the billet is held at 500 to 730° C. for 60 min; heating the billet to 950 to 1250° C., and performing hot rolling of the billet to make a wire rod at rolling temperature (Tr) of 800° C. or more and finish rolling temperature (Tf) of 1150° C. or less; placing the hot-rolled wire rod on a cooling bed at coiling temperature (TL) of 1020° C. or less; and cooling the wire at an average cooling rate (CR1) of 2° C./sec or more from the coiling temperature (TL) to 730° C., and at an average cooling rate (CR2) of 5° C./sec or less from the coiling temperature (TL) to 500° C.

A fourth aspect of the manufacturing method of the embodiment of the invention includes: performing heating in which a billet satisfying requirement of the composition (except for the hydrogen content) is held at 500 to 730° C. for 60 min; performing homogenizing treatment in which the billet is held at 1250 to 1350° C. for 60 min; heating the billet to 950 to 1250° C., and performing hot rolling of the billet to make a hot-rolled wire rod at rolling temperature (Tr) of 800° C. or more and finish rolling temperature (Tf) of 1150° C. or less; placing the hot-rolled wire rod on a cooling bed at coiling temperature (TL) of 1020° C. or less to make a wire; and cooling the wire at an average cooling rate (CR1) of 2° C./sec or more from the coiling temperature (TL) to 730° C., and at an average cooling rate (CR2) of 5° C./sec or less from the coiling temperature (TL) to 500° C.

Furthermore, an embodiment of the invention provides a method of reducing the content of hydrogen in steel, including heating in which a billet is held at 500 to 730° C. for 60 min or more, the hydrogen having adverse effect on wire drawability.

The inventors found that each of the contents of C, Si, Mn, Cr, P, S, N, Al and O in steel was specified, and the content of hydrogen in steel was decreased, and hardness was controlled to be in a certain range or lower, thereby the hot-rolled wire rod excelling in wire drawability was able to be provided, in which breakage was suppressed even in heavy work using wire rods having large diameters.

BRIEF DESCRIPTION OF THE DRAWINGS

FIG. 1 is a graph showing a relationship between hardness and $C_0$ (=the content of C (percent by mass) in a position of depth of D/4 (D: diameter of a wire rod)) of a wire rod obtained in an example.

BEST MODE FOR CARRYING OUT THE INVENTION

In the wire rod according to the embodiment of the invention, the content of hydrogen in steel is decreased to achieve excellent wire drawability. It has been known so far that hydrogen adversely affects the steel under a stress loading condition lasting a long period of time wherein the hydrogen can sufficiently diffuse, for example, in the case of delayed fracture, but it has been considered that hydrogen does not adversely affect the steel under a stress loading condition lasting a comparatively short period of time, such as in wire drawing. However, the inventors found that the hydrogen in steel, which had not been regarded as a particular problem, had a large effect on wire drawability under a heavy wire-drawing condition. When there are carbonitrides and the like of an alloy element, which was added for increasing strength in the wire rod, since they acts as hydrogen traps, the hydrogen content in steel is increased.

A reason for the adverse effect of the hydrogen in heavy wire drawing is presumed to be because work hardening due to heavy work causes increase in strength which in turn increases hydrogen embrittlement sensibility, or hydrogen that has been fixed to a trap site is released from the site by temperature rise due to heavy work, and contributes to the embrittlement. However, the embodiment of the invention is not limited to such presumption.

To sufficiently suppress the breakage even in heavy work, the content of hydrogen in steel of the hot-rolled wire rod needs to be 2.50 ppm or less. The content of hydrogen in steel is preferably 2 ppm or less, and more preferably 1.5 ppm or less.

The content of hydrogen in steel can be measured using APIMS (Atmospheric Pressure Ionization Mass Spectrometer). A value of "the content of hydrogen in steel" in the embodiment of the invention is made by sampling a disk-like sample (thickness: 2 mm) by cutting a wire rod, then measuring the total content of hydrogen evaluated from the sample from room temperatures to 350° C. under a condition of a heating rate of 10 K/min using APIMS.

As a result of further investigation, the inventors found that there was a certain relationship between wire drawability and hardness of a wire rod, and when initial hardness of the wire rod was high, breakage was apt to occur during wire drawing. The reason for this is considered to be because when the initial hardness is high, fracture sensitivity is increased since work hardening becomes more significant, or effect of heat due to work is significant. However, the embodiment of the invention is not limited to such presumption.

Hardness of a wire rod is mainly affected by the content of C and a structure of the wire rod. Generally, as the content of C is increased, or an amount of a martensite structure as the supercooled microstructure is increased, hardness is increased. The microstructure of the wire rod affects wire drawability similarly as hardness. Specifically, it is considered that the larger the amount of martensite, the more easily breakage occurs in a wire rod.

As hereinbefore, wire drawability of a wire rod (breakability) is affected not only by hardness, but also by its microstructure. Therefore, even in wire rods having the same hardness, breakage easily occur in a wire rod having a low content of C and a large amount of martensite structure compared with a wire rod having a high content of C and a large amount of ferrite-pearlite structure. Accordingly, it can be said that breakage hardly occurs in a wire rod having the high content of C compared with a wire rod having the low content of C if they have the same hardness, in addition, it can be considered that a reference value (maximum value) of hardness allowed in a wire rod having excellent wire drawability can be set high in the wire rod having a high content of C.

Based on consideration as above, still in the light of the microstructure, "hardness (HV) of $460\times C_0^{0.1}$ or less ($C_0$ indicates the content of C (percent by mass) in a position of depth of D/4 (D: diameter of the wire rod)) was determined as a requirement of hardness. The requirement of hardness$\leq 460\times C_0^{0.1}$ is obtained in the following way.

In the following embodiments, when data of "$C_0$" and "hardness" of a wire rod (comparative example, black circles in FIG. 1), of which the wire drawability is considered to be reduced due to high hardness, are subjected to power approximation, a curve in a solid line as shown in FIG. 1 is obtained (approximate expression: hardness$=466.06\times C_0^{0.10}$ ($R^2=0.62$)).

In this approximate expression (hardness$=466.06\times C_0^{0.10}$), as a value of $C_0$ is increased, a value of hardness is also increased, and conversely as the value of $C_0$ is decreased, the value of hardness is also decreased. Accordingly, the inventors considered the approximate expression as an expression indicating a reference value (maximum value) of hardness of a wire rod that is easily broken in consideration including the microstructure. In FIG. 1, a region of a curve in a broken line (hardness$=460\times C_0^{0.10}$) or lower, which is below the curve in the solid line (approximate curve of the comparative example), that is, a region of "hardness$\leq 460\times C_0^{0.10}$" was determined as a range of hardness to be satisfied by the wire rod of the embodiment of the invention. A preferable range is "hardness$\leq 450\times C_0^{0.10}$" (a region of a curve in a chain line or lower in FIG. 1), and a more preferable range is "hardness$\leq 440\times C_0^{0.10}$" (a region of a curve in a dot line or lower in FIG. 1).

When the structure is not considered, it is considered that as hardness is decreased, wire drawability is improved. Accordingly, in the embodiment of the invention, a maximum value of hardness (HV) of the wire rod is preferably 420, more preferably 410 or less, and further preferably 400 or less.

The value of "hardness" in the embodiment of the invention is a simple arithmetic mean value of values obtained by cutting a wire rod in a lateral cross section to prepare at least three samples per wire rod, then measuring hardness at four points or more in positions of depth of D/4 of each sample by a Vickers hardness tester (load of 1 kgf).

Among the hot-rolled wire rods of the embodiment of the invention, a wire rod is preferable, which has an average grain diameter ($D_{ave}$) of 20 μm or less and a maximum grain diameter ($D_{max}$) of 80 μm or less in a bcc-Fe grain of a metallographic structure. This is because it was found that start points of breakage or working defects during wire drawing were easily generated in the case of coarse grains, and furthermore even if an average value of grain diameter was made small, when there were some coarse grains, breakage easily occurred. As both of the average grain diameter ($D_{ave}$) and the maximum grain diameter ($D_{max}$) are smaller, wire drawability is improved. More preferably, the average grain diameter ($D_{ave}$) is 15 μm or less, and the maximum grain diameter ($D_{max}$) is 60 μm or less. Values of the average grain diameter ($D_{ave}$) and the maximum grain diameter ($D_{max}$) in the embodiment of the invention are measuring values in the center of a wire diameter of a wire rod.

The values of the average grain diameter ($D_{ave}$) and the maximum grain diameter ($D_{max}$) in the embodiment of the invention are values measured in the following way using a SEM/EBSP (Electron Back Scatter diffraction Pattern) method.

First, a sample 10 mm in length is taken from a wire rod by wet cutting, then as sample preparation for EBSP measurement, wet polishing, buffing, and chemical polishing are performed so that a sample is prepared, in which strain and irregularity due to polishing are reduced to the utmost. At that time, the polishing is performed such that an observation surface corresponds to a center of wire diameter in a vertical section of the wire rod. Using an obtained sample, measurement is performed with the center of wire diameter of the wire rod as an EBSP measurement point. At that time, a measurement step is set to be 0.5 μm or less such that a measurement area of each wire rod is 60,000 $\mu m^2$ or more. After measurement, crystal orientation is analyzed, in which measuring results having an average CI (Confidence Index) value of 0.3 or more are used to improve reliability of the analysis.

Analytical results (boundary map) are collected assuming that a region enclosed by a boundary line having difference in azimuth of 10 degrees or more by analysis of the bcc-Fe crystal orientation is the "grain" in the embodiment of the invention. In the obtained boundary map, an area of an individual region (crystal unit) enclosed by the boundary line is obtained using an image analysis software "Image-Pro" (manufactured by ADVANSOFT Ltd.), then circle equivalent diameter (diameter) is calculated from the area as the grain diameter of an individual grain. The measurement is performed for at least three samples, and the average grain diameter ($D_{ave}$) as the number average diameter, and the maximum grain diameter ($D_{max}$) are calculated based on all measurement data.

In the hot-rolled wire rod according to the embodiment of the invention, to further improve the wire drawability, segregation of C is preferably controlled such that the following equation (1) is satisfied:

$$C_{max}/C_0 \leq 1.20 \quad (1)$$

(wherein $C_{max}$ indicates the content of C (percent by mass) in a position of depth of D/2 (D: diameter of the wire rod)), and $C_0$ indicates the content of C (percent by mass) in the position of depth of D/4).

This is because when the segregation of C is excessive, wire drawability may be reduced because work hardening during wire drawing may become uneven within a wire rod, or voids are easily generated in a segregation site of C. The $C_{max}/C_0$ of the wire rod in the embodiment of the invention is preferably 1.15 or less, and more preferably 1.10 or less.

The embodiment of the invention adopted the content of C (percent by mass) in the position of depth of D/2 (D: diameter of the wire rod) as a value of $C_{max}$. This is because segregation of carbon is significant in the central portion of the wire rod. Furthermore, the embodiment adopted the content of C (percent by mass) in the position of depth of D/4 as a value of $C_0$. This is for avoiding effect of a decarburized site in a surface and the segregation site of C in the center. The value of the $C_{max}$ or $C_0$ in the embodiment of the invention is measured by a combustion infrared absorption method using a powdered sample taken from the position of depth of D/2 or D/4, respectively.

The embodiment of the invention specifies a chemical composition in addition to the content of hydrogen in steel and hardness of the hot-rolled wire rod. This is because when each chemical component is not within an appropriate range, the wire drawability is reduced. Hereinafter, chemical components of the wire rod are described.

[C Content: 0.35 to 0.65%]

C is an element affecting strength of steel materials, and as the C component is increased, the strength is increased. The C content of at least 0.35% is necessary to use the wire rod for high-strength springs. Preferably, the minimum C content is 0.40%. However, since an excessive C content may reduce the wire drawability, a maximum C content is specified as 0.65%. More preferably, the maximum C content is 0.60%.

[Si Content: 1.4 to 3.0%]

Si is an element effective for improving sag resistance necessary for springs. The Si content of at least 1.4% is necessary to use the wire rod of the embodiment of the invention for high-strength springs. The minimum Si content is preferably 1.6%, and more preferably 1.8%. However, since Si accelerates decarburization, an excessive Si content may cause breakage to easily occur during the wire drawing. Thus, a maximum Si content is specified as 3.0%. The maximum Si content is preferably 2.5%, and more preferably 2.2% or less.

[Mn Content: 0.10 to 1.0%]

Mn is used for a deoxidizing element, and is a useful element to form MnS to detoxify S which is a harmful element in the steel. To sufficiently exhibit these advantageous effects, the Mn content needs to be 0.10% or more. A minimum Mn content is preferably 0.15%, and more preferably 0.2% or more. However, when the Mn content is excessive, a segregation band is formed, which reduces the wire drawability, in addition, a supercooled microstructure, which is not preferable for wire drawing, is easily formed. Thus, a maximum Mn content was specified as 1.0%. The maximum Mn content is preferably 0.85%, and more preferably 0.75% or less.

[Cr Content: 0.1 to 2.0%]

Cr is effective for securing strength of the wire rod after tempering. Moreover, it has an advantage of improving corrosion resistance, and is an important element for suspension springs requiring corrosion durability. A minimum Cr content was specified as 0.1% to sufficiently exhibit these advantages. The minimum Cr content is preferably 0.15%, and more preferably 0.2% or more. However, when the Cr content is excessive, segregation easily occurs or the supercooled microstructure is easily formed, reducing the wire drawability. Thus, a maximum Cr content is specified as 2.0%. The maximum Cr content is preferably 1.8%, and more preferably 1.6% or less.

[P Content: 0.025% or Less (Exclusive of 0%)]

The content of P is preferably low, because it reduces the wire drawability of the wire rod. Accordingly, the P content is 0.025% or less, preferably 0.020% or less, and more preferably 0.015% or less.

[S Content: 0.025% or Less (Exclusive of 0%)]

The content of S is preferably low because it reduces the wire drawability of the wire rod. Accordingly, the S content is 0.025% or less, preferably 0.020% or less, and more preferably 0.015% or less.

[N content: 0.006% or less (exclusive of 0%)]

N in a state of dissolved nitrogen may reduce the wire drawability. Thus, a maximum N content is specified as 0.006%. The maximum N content is preferably 0.004%, and more preferably 0.003% or less. However, when a wire rod contains an element forming nitrides, such as Al or Ti, N may effectively work for formation of a fine structure. Accordingly, a minimum N content is preferably 0.0015%, and more preferably at least 0.0020%.

[Al Content: 0.1% or Less (Exclusive of 0%)]

Al is added mainly as a deoxidizing element. Moreover, Al forms AlN to fix N to be harmless, in addition, it contributes to formation of a fine structure. For fixing N, Al is preferably contained in the content of more than two times as much as the N content. Desirably, the content of Al is preferably more than 0.0030%, and more preferably more than 0.0040%. However, since Al accelerates decarburization, particularly in spring steels containing a large amount of Si, the excessive Al content is not preferable. Thus, a maximum Al content is specified as 0.1%. The maximum Al content is preferably 0.07%, more preferably 0.05% or less, and further preferably 0.03% or less.

[O Content: 0.0030% or Less (Exclusive of 0%)]

When the content of oxygen in steel is increased, since coarse oxides are formed, reducing the wire drawability, the content is preferably small. Accordingly, the maximum O content is specified as 0.0030%. The maximum O content is preferably 0.0020%, and more preferably 0.0015% or less.

A basic composition of the wire rod of the embodiment of invention is as above, and the remnant is substantially Fe. However, the wire rod is obviously allowed to contain inevitable impurities introduced depending on conditions of raw materials, other materials, and manufacturing equipment. Furthermore, the wire rod of the embodiment of invention may contain the following optional elements as necessary.

[Ni Content: 1% or Less]

Ni has an advantage of suppressing superficial decarburization, in addition, an advantage of improving corrosion resistance. To sufficiently exhibit the advantages, the content of Ni is preferably at least 0.1%, and more preferably at least 0.2%, as necessary. However, when the Ni content is excessive, the supercooled microstructure is easily formed, consequently the wire drawability is reduced. Accordingly, when Ni is contained, the Ni content is preferably 1% or less, more preferably 0.8% or less, and further preferably 0.6% or less.

[Cu Content: 1.0% or Less]

Cu also has the advantage of suppressing superficial decarburization, and in addition, the advantage of improving corrosion resistance, similar to Ni. To sufficiently exhibit the advantages, the content of Cu is preferably at least 0.1%, and more preferably at least 0.2%, as necessary. However, when the Cu content is excessive, a supercooled microstructure is easily formed, and consequently, the wire drawability is reduced. Moreover, cracks may occur during hot working. Accordingly, when Cu is contained, the Cu content is preferably 1.0% or less, more preferably 0.8% or less, and further preferably 0.6% or less.

Ni and Cu are common in that they contribute to suppressing the superficial decarburization and improving corrosion resistance. Therefore, the hot-rolled wire rod preferably contains at least one of Ni and Cu in the amount stated above.

[V Content: 0.30% or Less]

V mainly forms carbonitrides with C and N and thus contributes to formation of a fine structure. To sufficiently exhibit the advantage, the content of V is preferably at least 0.01%, and more preferably at least 0.05%, as necessary. However, when the V content is excessive, the wire drawability is reduced. Accordingly, when V is contained, the V content is preferably 0.30% or less, more preferably 0.2% or less, and further preferably 0.15% or less.

[Ti Content: 0.10% or Less]

Ti forms carbonitrides or sulfides with C and N, or S, and thus works to detoxify N and S. Moreover, Ti carbonitrides have an advantage of contributing to formation of the fine structure. To sufficiently exhibit the advantages, the content of Ti is preferably 0.01% or more, as necessary. From a viewpoint of fixing N, the Ti content is preferably more than three and half times the N content. However, when the Ti content is excessive, coarse carbonitrides are formed, and consequently the wire drawability may be reduced. Accordingly, when Ti is contained, the Ti content is preferably 0.10% or less, more preferably 0.07% or less, and further preferably 0.05% or less.

[Nb Content: 0.1% or Less]

Nb forms carbonitrides with C and N and thus contributes to formation of the fine structure. To sufficiently exhibit the advantage, the content of Nb is preferably at least 0.01%, and more preferably at least 0.03%, as necessary. However, when the Nb content is excessive, coarse carbonitrides are formed, and consequently the wire drawability is reduced. Accordingly, when Nb is contained, the Nb content is preferably 0.1% or less, more preferably 0.07% or less, and further preferably 0.05% or less.

[Zr Content: 0.10% or Less]

Zr forms carbonitrides and thus contributes to formation of the fine structure. To sufficiently exhibit the advantage, the content of Zr is preferably 0.01% or more, and more preferably 0.02% or more, as necessary. However, when the Zr content is excessive, coarse carbonitrides are formed, and consequently the wire drawability is reduced. Accordingly, when Zr is contained, the Zr content is preferably 0.10% or less, more preferably 0.07% or less, and further preferably 0.05% or less.

V, Ti, and Nb are common in that they contribute to formation of the fine structure by forming carbonitrides. The hot-rolled wire rod preferably contains at least one of V, Ti, and Nb of the amount stated above.

[Mo Content: 1.0% or Less]

Mo forms carbonitrides with C and N, and concentrates in cementite and thus contributes to securing strength. To sufficiently exhibit the advantages, the content of Mo is preferably at least 0.1%, and more preferably at least 0.2%, as necessary. However, when the Mo content is excessive, the supercooled microstructure is easily formed, and consequently the wire drawability is reduced. Accordingly, when Mo is contained, the Mo content is preferably 1.0% or less, more preferably 0.7% or less, and further preferably 0.5% or less.

[B Content: 50 ppm or Less]

B forms nitrides and thus detoxifies N. To sufficiently exhibit the advantage, the content of B is preferably at least 1 ppm, more preferably 3 ppm or more, and further preferably at least 5 ppm, as necessary. However, when the B content is excessive, since coarse carbonitrides and the supercooled microstructure are formed, the wire drawability is reduced. Accordingly, when B is contained, the B content is preferably 50 ppm or less, more preferably 40 ppm or less, and further preferably 30 ppm or less.

[Mg Content: 50 ppm or Less]

Mg has an advantage of softening oxides and thus improving the wire drawability. To sufficiently exhibit the advantage, the content of Mg is preferably at least 0.1 ppm, more preferably at least 1 ppm, and further preferably at least 10 ppm, as necessary. However, when the Mg content is excessive, properties of the oxides are changed, and consequently the wire drawability may be rather reduced. Accordingly, when Mg is contained, the Mg content is preferably 50 ppm or less, and more preferably 40 ppm or less.

[Ca Content: 50 ppm or Less]

Ca has an advantage of softening oxides and thus improving the wire drawability. To sufficiently exhibit the advantage, the content of Ca is preferably at least 0.1 ppm, more preferably at least 1 ppm, and further preferably at least 10 ppm, as necessary. However, when the Ca content is excessive, properties of the oxides are changed, and consequently the wire drawability may be rather reduced. Accordingly, when Ca is contained, the Ca content is preferably 50 ppm or less, and more preferably 40 ppm or less.

Mg and Ca are common in that they improve the wire drawability by softening oxides. Therefore, the hot-rolled wire rod preferably contains at least one of Mg and Ca in the amount stated above.

[Content of Rare Earth Elements: 1.5 ppm or Less]

Rare earth elements (sometimes abbreviated as "REM") have an advantage of softening oxides and thus improving the wire drawability. To sufficiently exhibit the advantage, the content of REM is preferably at least 0.1 ppm, as necessary. However, when the content of REM is excessive, properties of the oxides are changed, and consequently the wire drawability may be rather reduced. Accordingly, when REM is contained, the content of REM is preferably 1.5 ppm or less, and more preferably 0.5 ppm or less. Preferable elements among REM are La, Ce, Pr and Nd, and one or at least two of them can be used.

The hot-rolled wire rod satisfying requirements of the content of hydrogen in steel and the hardness (preferably, requirement of the grain diameter in addition) can be manufactured by: performing heating in which a billet satisfying the requirement of the composition is held at 500 to 730° C. for 60 min; heating the billet to 950 to 1250° C., and performing hot rolling of the billet to make a wire rod at rolling temperature (Tr) of 800° C. or more and finish rolling temperature (Tf) of 1150° C. or less; placing the hot-rolled wire rod on a cooling bed at coiling temperature (TL) of 1020° C. or less to make a wire; and cooling the wire at an average cooling rate (CR2) of 5° C./sec or less from the coiling temperature (TL) to 500° C. (preferably at an average cooling rate (CR1) of 2° C./sec or more from the coiling temperature (TL) to 730° C.). Hereinafter, each of steps of this manufacturing method is described.

Hydrogen may enter steel during a manufacturing process of the steel (wire rod). In particular, since the hot-rolled wire rod of the embodiment of the invention, and the billet for obtaining the wire rod contain various alloy elements, carbonitrides or nonmetal inclusions of them may form hydrogen trap sites, thereby hydrogen easily accumulates in steel. Since the hydrogen traps are robust, hydrogen is hardly released from the trap under a condition of the normal temperature. The inventors evaluated trap capability of the hydrogen trap sites, and as a result, found that the steel was acceptably subjected to heating in which it was held at a temperature of 500° C. or more for 60 min or more in order to effectively decrease the content of hydrogen in steel. However, they further found that when the billet was excessively heated to high temperature at which austenite was formed, since hydrogen was easily dissolved in austenite compared with ferrite, hydrogen was rather hard to be released.

Accordingly, to efficiently decrease the content of hydrogen in steel of the wire rod, a billet before rolling can be heated at 500 to 730° C., preferably 550 to 700° C., for 60 min or more, preferably for 120 min or more. The heating before rolling is important as a step in a method of manufacturing a hot-rolled wire rod excelling in wire drawability, and useful as a method of decreasing hydrogen in steel of the hot-rolled wire rod. The heating may be performed in either of an inline that is the same as a rolling line and an offline separated from the rolling line.

Then, the billet satisfying the requirement of the composition is heated to the range of 950 to 1250° C., preferably 1000 to 1200° C., and subjected to hot rolling at the rolling temperature (Tr) of at least 800° C., preferably at least 850° C., and more preferably at least 900° C., and the finish rolling temperature (Tf) of 1150° C. or less, and preferably 1100° C. or less. In both cases of extremely low and high heating temperature before rolling, decarburization occurs in the surface of the wire rod. When the rolling temperature is less than 800° C., possibility of decarburization is increased. When the finish rolling temperature is a high temperature of more than 1150° C., hardenability is increased due to growth of austenite grains, causing increase in hardenability, and consequently, strength of the wire rod may be excessively increased.

It is recommended that the wire rod is placed on the cooling bed at the coiling temperature (TL) of 1020° C. or less, preferably 980° C. or less, and more preferably 950° C. or less. This is because when the coiling temperature exceeds 1020° C., austenite grain size is enlarged. It is necessary to decrease hardness of the wire rod that the wire rod is cooled at the average cooling rate (CR2) of 5° C./sec or less from the coiling temperature (TL) to 500° C. Furthermore, by such slow cooling from the coiling temperature (TL) to 500° C., the content of hydrogen in steel can be further decreased. CR2 is preferably 4° C./sec or less, and more preferably 3° C./sec or less.

However, to form a fine structure due by inhibiting growth of austenite grains and decrease in hardness, it is effective that the cooling rate CR1 from the coiling temperature (TL) to 730° C. is preferably at least 2° C./sec, more preferably at least 5° C./sec, and further preferably at least 8° C./sec.

To suppress segregation of C so that $C_{max}/C_0$ is 1.20 or less, soaking is added to the manufacturing method, in which the billet satisfying the requirement of the composition is held at 1250 to 1350° C., preferably 1280 to 1310° C., for 60 min or more, preferably for 120 min or more, before rolling. The soaking may be performed in either of an inline that is the same as the rolling line and an offline separated from the rolling line. Moreover, it may be performed before or after the heating for decreasing the content of hydrogen in steel.

However, to further decrease the content of hydrogen in steel, it is preferable that the soaking is performed to eliminate the segregation band before the heating. Moreover, it is preferable that the soaking requiring high temperature is performed in an offline different from the rolling line, and the heating for decreasing the content of hydrogen in steel is performed in the inline that is the same as the rolling line, in addition, from a viewpoint of equipment, it is preferable that first the soaking is performed before the heating.

In the embodiment of the invention, wire diameter of the hot-rolled wire rod is not particularly limited. However, the wire diameter is preferably large to suppress formation of the supercooled microstructure. The wire rod of the embodiment of the invention is excellent in wire drawability, therefore breakage can be effectively suppressed even if the rod is subjected to heavy work from a large diameter. Accordingly, a minimum wire diameter is preferably 8 mm, more preferably at least 10 mm, and further preferably at least 12 mm. On the other hand, since excessive large wire diameter causes difficulty in wire drawing, a maximum wire diameter is preferably 25 mm, more preferably 20 mm, and further preferably 18 mm.

Embodiment

Hereinafter, while the invention will be described more specifically with an embodiment, the invention is not limited by the following embodiment, and it can be obviously practiced by being appropriately modified within a scope adaptable to the purport described before and after, and any of such modifications may be covered within a technical scope of the invention.

[Manufacturing of Wire Rods]

Steel materials having chemical compositions listed in Tables 1-1 to 1-2 (the remnant: iron and inevitable impurities) were ingoted, and shaped into billets 155 mm square. Next, soaking, heating, hot rolling, coiling, and cooling were performed in order under conditions listed in Tables 2-1 to 2-3, and consequently, hot-rolled wire rods 8.0 to 18 mm in wire diameter were manufactured.

TABLE 1-1

| | Mass percent | | | | | | | | |
|---|---|---|---|---|---|---|---|---|---|
| Steel type No. | C | Si | Mn | Cr | P | S | N | Al | O |
| A1 | 0.38 | 1.78 | 0.20 | 1.05 | 0.008 | 0.008 | 0.0041 | 0.0300 | 0.0019 |
| A2 | 0.40 | 2.09 | 0.85 | 1.83 | 0.003 | 0.002 | 0.0032 | 0.0321 | 0.0018 |
| A3 | 0.42 | 2.71 | 0.94 | 1.92 | 0.002 | 0.002 | 0.0028 | 0.0003 | 0.0010 |
| A4 | 0.44 | 1.92 | 0.18 | 1.00 | 0.008 | 0.007 | 0.0039 | 0.0310 | 0.0012 |
| A5 | 0.47 | 2.05 | 0.79 | 0.18 | 0.015 | 0.016 | 0.0035 | 0.0280 | 0.0011 |
| A6 | 0.50 | 2.01 | 0.62 | 1.21 | 0.021 | 0.020 | 0.0028 | 0.0300 | 0.0011 |
| A7 | 0.50 | 2.01 | 0.62 | 1.21 | 0.027 | 0.020 | 0.0028 | 0.0300 | 0.0011 |
| A8 | 0.50 | 2.01 | 0.39 | 1.83 | 0.013 | 0.014 | 0.0032 | 0.0300 | 0.0008 |
| A9 | 0.50 | 2.18 | 0.18 | 1.20 | 0.005 | 0.006 | 0.0028 | 0.0320 | 0.0005 |
| A10 | 0.51 | 2.40 | 0.18 | 1.02 | 0.004 | 0.005 | 0.0030 | 0.0310 | 0.0005 |
| A11 | 0.52 | 2.41 | 0.18 | 1.04 | 0.004 | 0.006 | 0.0032 | 0.0290 | 0.0009 |
| A12 | 0.55 | 1.81 | 0.77 | 0.70 | 0.013 | 0.009 | 0.0041 | 0.0003 | 0.0012 |
| A13 | 0.55 | 2.32 | 0.92 | 1.88 | 0.003 | 0.003 | 0.0033 | 0.0015 | 0.0011 |
| A14 | 0.57 | 1.41 | 0.76 | 0.70 | 0.016 | 0.016 | 0.0039 | 0.0320 | 0.0014 |
| A15 | 0.58 | 0.19 | 0.90 | 0.85 | 0.014 | 0.013 | 0.0066 | 0.5210 | 0.0034 |
| A16 | 0.61 | 3.12 | 1.21 | 0.20 | 0.005 | 0.004 | 0.0030 | 0.0005 | 0.0007 |
| A17 | 0.61 | 1.47 | 0.53 | 0.54 | 0.012 | 0.007 | 0.0029 | 0.0270 | 0.0010 |
| A18 | 0.63 | 1.62 | 0.51 | 0.72 | 0.008 | 0.008 | 0.0030 | 0.0310 | 0.0011 |
| A19 | 0.70 | 0.18 | 0.50 | 2.12 | 0.005 | 0.004 | 0.0025 | 0.0015 | 0.0010 |
| A20 | 0.81 | 0.20 | 0.07 | | 0.015 | 0.026 | 0.0027 | 0.0210 | 0.0022 |

TABLE 1-2

| Steel | Mass percent | | | | | | | PPM by mass | | | |
|---|---|---|---|---|---|---|---|---|---|---|---|
| type No. | Ni | Cu | Mo | V | Ti | Nb | Zr | Mg | Ca | REM | B |
| A1 | 0.53 | 0.22 | 0.0 | 0.168 | 0.065 | | | 0.2 | 2.7 | | 1.0 |
| A2 | | | | | | | | | | | |
| A3 | | | | | | | | | | | |
| A4 | 0.50 | 0.25 | 0.0 | 0.155 | 0.068 | | | 0.1 | 1.8 | | 1.0 |
| A5 | 0.30 | 0.28 | 0.0 | 0.156 | 0.072 | | | 0.1 | 1.9 | 0.1 | |
| A6 | 0.02 | 0.01 | 0.6 | | 0.051 | 0.008 | | | | | |
| A7 | 0.02 | 0.01 | 1.2 | 0.080 | 0.051 | | | | | | |
| A8 | 0.01 | 0.02 | | 0.079 | 0.048 | | | | | | |
| A9 | 0.40 | 0.39 | | | 0.070 | | | 35.0 | 34.0 | | 23.0 |
| A10 | 0.60 | 0.58 | | | 0.050 | | | 35.0 | 38.0 | | 22.0 |
| A11 | 0.61 | 0.57 | | | 0.050 | | | | | | 1.0 |
| A12 | | 0.03 | | | | 0.007 | 0.072 | 0.1 | 1.2 | 0.1 | |
| A13 | | | | | | | | | | | |
| A14 | 0.02 | 0.03 | | | 0.020 | | | 0.1 | 1.3 | | 1.0 |
| A15 | | | | | | | | | 0.7 | | |
| A16 | 1.22 | 1.09 | | | | | | 0.2 | 2.5 | 0.1 | |

TABLE 1-2-continued

| Steel | Mass percent | | | | | | | PPM by mass | | | |
|---|---|---|---|---|---|---|---|---|---|---|---|
| type No. | Ni | Cu | Mo | V | Ti | Nb | Zr | Mg | Ca | REM | B |
| A17 | | | | 0.168 | | | | | | | |
| A18 | | | | | 0.075 | 0.059 | | | | | |
| A19 | | | | 0.321 | | | 0.105 | | | | |
| A20 | | | | | 0.110 | | | 0.1 | 0.8 | | 55.0 |

REM: the total content of La, Ce, Pr and Nd

TABLE 2-1

| | | Soaking | | Heating | | Rolling | | | | Cooling | |
|---|---|---|---|---|---|---|---|---|---|---|---|
| | | | | | | Heating | Minimum rolling | Finish rolling | Coiling | Cooling rate | Cooling rate |
| Steel type No. | Wire rod No. | Temperature ° C. | Time minutes | Temperature ° C. | Time minutes | temperature ° C. | temperature ° C. | temperature ° C. | temperature ° C. | CR1 ° C./sec | CR2 ° C./sec |
| A1 | A1-1 | — | — | — | — | 1240 | 950 | 1080 | 990 | 12.0 | 3.5 |
| | A1-2 | — | — | 600 | 120 | 1240 | 950 | 1080 | 990 | 12.0 | 3.1 |
| | A1-3 | — | — | 700 | 120 | 1240 | 950 | 1080 | 990 | 12.2 | 3.7 |
| | A1-4 | — | — | 700 | 120 | 1220 | 950 | 1170 | 1050 | 12.2 | 6.1 |
| | A1-5 | 1280 | 60 | 550 | 120 | 1220 | 950 | 1045 | 960 | 7.1 | 2.5 |
| | A1-6 | 1280 | 60 | 600 | 60 | 1220 | 950 | 1045 | 960 | 9.2 | 2.9 |
| | A1-7 | 1280 | 60 | 700 | 60 | 1220 | 950 | 1045 | 960 | 6.3 | 2.2 |
| | A1-8 | 1280 | 60 | 700 | 60 | 1220 | 950 | 1020 | 960 | 3.7 | 1.4 |
| A2 | A2-1 | 1310 | 60 | 600 | 60 | 1230 | 1000 | 1070 | 990 | 4.2 | 1.3 |
| A3 | A3-1 | 1310 | 60 | 600 | 60 | 1230 | 1000 | 1070 | 990 | 4.0 | 1.1 |
| A4 | A4-1 | — | — | 600 | 20 | 1220 | 950 | 1045 | 950 | 13.0 | 5.5 |
| | A4-2 | — | — | 600 | 60 | 1220 | 950 | 1045 | 950 | 8.8 | 2.6 |
| | A4-3 | — | — | 600 | 60 | 1220 | 950 | 1045 | 950 | 7.3 | 2.5 |
| | A4-4 | — | — | 700 | 60 | 1220 | 950 | 1045 | 950 | 12.0 | 3.7 |
| | A4-5 | 1310 | 60 | 600 | 60 | 1200 | 920 | 1080 | 980 | 1.0 | 1.2 |
| | A4-6 | 1310 | 60 | 600 | 60 | 1200 | 920 | 1080 | 980 | 16.0 | 2.7 |

TABLE 2-2

| | | Soaking | | Heating | | Rolling | | | | Cooling | |
|---|---|---|---|---|---|---|---|---|---|---|---|
| | | | | | | Heating | Minimum rolling | Finish rolling | Coiling | Cooling rate | Cooling rate |
| Steel type No. | Wire rod No. | Temperature ° C. | Time minutes | Temperature ° C. | Time minutes | temperature ° C. | temperature ° C. | temperature ° C. | temperature ° C. | CR1 ° C./sec | CR2 ° C./sec |
| A5 | A5-1 | 1260 | 60 | 550 | 20 | 1200 | 950 | 1045 | 980 | 15.2 | 6.8 |
| | A5-2 | 1260 | 60 | 550 | 40 | 1200 | 950 | 1045 | 980 | 12.8 | 5.9 |
| | A5-3 | 1260 | 60 | 550 | 120 | 1200 | 950 | 1045 | 980 | 0.5 | 2.8 |
| | A5-4 | 1260 | 60 | 600 | 60 | 1200 | 950 | 1045 | 950 | 6.7 | 1.8 |
| | A5-5 | 1260 | 60 | 600 | 60 | 1200 | 950 | 1045 | 950 | 3.8 | 1.7 |
| A6 | A6-1 | 1310 | 60 | — | — | 1170 | 920 | 1020 | 925 | 12.2 | 2.3 |
| | A6-2 | 1310 | 60 | 700 | 60 | 1170 | 920 | 1020 | 925 | 12.5 | 2.0 |
| A7 | A7-1 | 1280 | 60 | — | — | 1170 | 920 | 1020 | 925 | 12.1 | 2.9 |
| | A7-2 | 1280 | 60 | 700 | 60 | 1170 | 920 | 1020 | 925 | 12.0 | 3.7 |
| A8 | A8-1 | 1280 | 60 | — | — | 1200 | 920 | 1000 | 925 | 2.7 | 1.5 |
| | A8-2 | 1280 | 60 | 720 | 60 | 1200 | 920 | 1000 | 925 | 2.5 | 1.4 |
| A9 | A9-1 | — | — | — | — | 1200 | 920 | 1000 | 925 | 2.5 | 1.8 |
| | A9-2 | — | — | 650 | 120 | 1200 | 920 | 1000 | 925 | 2.4 | 1.7 |
| A10 | A10-1 | 1280 | 60 | 650 | 120 | 1150 | 900 | 990 | 900 | 10.0 | 1.3 |
| A11 | A11-1 | 1280 | 60 | 650 | 120 | 1150 | 900 | 990 | 900 | 9.7 | 1.4 |

TABLE 2-3

| | | Soaking | | Heating | | Rolling | | | | Cooling | |
|---|---|---|---|---|---|---|---|---|---|---|---|
| | | | | | | Heating | Minimum rolling | Finish rolling | Coiling | Cooling rate | Cooling rate |
| Steel type No. | Wire rod No. | Temperature ° C. | Time minutes | Temperature ° C. | Time minutes | temperature ° C. | temperature ° C. | temperature ° C. | temperature ° C. | CR1 ° C./sec | CR2 ° C./sec |
| A12 | A10-1 | 1260 | 60 | 700 | 60 | 1050 | 850 | 1000 | 900 | 11.8 | 1.2 |
| A13 | A13-1 | 1310 | 60 | 600 | 60 | 1220 | 930 | 1030 | 990 | 4.5 | 1.4 |
| | A13-2 | 1310 | 60 | 600 | 60 | 1220 | 930 | 1030 | 990 | 10.1 | 2.1 |
| | A13-3 | 1310 | 60 | 600 | 60 | 1220 | 930 | 1030 | 990 | 14.3 | 3.2 |
| A14 | A14-1 | 1260 | 60 | 700 | 60 | 1000 | 850 | 900 | 880 | 11.2 | 1.2 |
| A15 | A15-1 | 1260 | 60 | 700 | 60 | 1000 | 850 | 900 | 880 | 10.8 | 1.5 |
| A16 | A16-1 | 1260 | 60 | 700 | 60 | 1150 | 900 | 950 | 925 | 10.2 | 1.9 |
| A17 | A17-1 | — | — | — | — | 1150 | 900 | 1050 | 925 | 8.9 | 2.2 |
| | A17-2 | — | — | 400 | 60 | 1150 | 900 | 1050 | 925 | 9.4 | 2.4 |
| | A17-3 | — | — | 600 | 60 | 1150 | 900 | 1080 | 925 | 9.0 | 2.0 |
| | A17-4 | — | — | 600 | 60 | 1100 | 870 | 1080 | 925 | 14.3 | 5.9 |
| | A17-5 | — | — | 700 | 60 | 1100 | 870 | 1080 | 900 | 15.7 | 3.1 |
| | A17-6 | — | — | 700 | 180 | 1100 | 870 | 1080 | 900 | 15.0 | 2.7 |
| | A17-7 | — | — | 700 | 180 | 1100 | 870 | 1080 | 900 | 15.0 | 0.4 |
| A18 | A18-1 | — | — | 700 | 180 | 1150 | 900 | 1000 | 925 | 15.7 | 1.8 |
| A19 | A19-1 | 1280 | 60 | 700 | 60 | 1150 | 900 | 1050 | 900 | 9.5 | 2.2 |
| A20 | A20-1 | 1280 | 60 | 700 | 60 | 1150 | 900 | 1050 | 900 | 10.3 | 2.4 |

[Content of Hydrogen in Steel]

As the content of hydrogen in steel, the total hydrogen content evaluated from a disk-like sample (thickness: 2 mm) from room temperatures to 350° C. under a condition of heating temperature of 10 K/min was measured using APIMS. Results are shown in Tables 3-1 to 3-3.

[Hardness]

The wire rods were cut in lateral cross sections to prepare three samples per wire rod, and at a position of depth of D/4 of each sample, hardness was measured at four points by a Vickers hardness tester (load: 1 kgf), and the simple arithmetic mean of obtained values was obtained, so that hardness of each wire rod was calculated. Results are shown in Tables 3-1 to 3-3.

A graph showing a relationship between $C_0$ ($C_0$ indicates the C content (mass percent) at the position of depth of D/4 (D: diameter of wire rod)) and hardness of each wire rod is represented as FIG. 1. In FIG. 1, black circles (beyond the hardness range of the present invention) are a plot of data of wire rods A1-4, A2-1, A3-1, A3-2 and A14-4; black squares (beyond the composition range of the present invention) are a plot of wire rod data obtained from steel types A5, A12, A13, A16 and A17; black triangles (beyond the hydrogen content range of the present invention) are a plot of data of wire rods A1-1, A4-1, A6-1, A7-1, A14-1 and A14-2; and white circles (inventive example) are a plot of other wire rod data.

The data of the wire rods A1-4, A2-1, A3-1, A3-2 and A14-4 were subjected to power approximation, consequently an approximate expression of hardness=$466.06\times C_0^{0.10}$ ($R^2$=0.62) was obtained. Such an approximate curve is also shown in FIG. 1 by a solid line. In FIG. 1, similarly, an approximate curve of $460\times C_0^{0.10}$ is shown in a broken line, an approximate curve of $450\times C_0^{0.10}$ is shown in a dashed line, and an approximate curve of $440\times C_0^{0.10}$ is shown in a dot line.

[Average Grain Diameter ($D_{ave}$) and Maximum Grain Diameter ($D_{max}$)]

A sample 10 mm in length was taken from each of the wire rods by wet cutting, then as sample preparation for EBSP measurement, wet polishing, buffing, and chemical polishing were performed so that a sample was prepared, in which strain and irregularity due to polishing were reduced to the utmost. At that time, the polishing was performed such that an observation surface corresponds to a center of wire diameter in a vertical section of the wire rod. Using an obtained sample, measurement was performed with the center of wire diameter of the wire rod as an EBSP measurement point. At that time, a measurement step was set to be 0.5 μm or less such that a measurement area of each wire rod was 60,000 $\mu m^2$ or more. After measurement, crystal orientation was analyzed, in which measuring results having an average CI value of 0.3 or more were used to improve reliability of the analysis.

Analytical results (boundary map) were obtained assuming that a region enclosed by a boundary line having difference in azimuth of 10 degrees or more by analysis of the bcc-Fe crystal orientation was the "grain" in the embodiment of the invention. In the obtained boundary map, an area of an individual region (crystal unit) enclosed by the boundary line was obtained using the image analysis software "Image-Pro" (manufactured by ADVANSOFT Ltd.), then circle equivalent diameter (diameter) was calculated from the area as the grain diameter of an individual grain. The measurement was performed for at least three samples, and the average grain diameter ($D_{ave}$) as the number average diameter, and the maximum grain diameter ($D_{max}$) were calculated based on all measurement data. Results are shown in Tables 3-1 to 3-3.

[$C_{max}/C_0$]

$C_{max}$ or $C_0$ was measured by a combustion infrared absorption method using a powdered sample taken from the position of depth of D/2 or D/4, respectively. Values of $C_{max}/C_0$ calculated using the $C_{max}$ and $C_0$ are shown in Tables 3-1 to 3-3.

[Wire Drawing]

Obtained wire rods were descaled by pickling, then applied with surface coating by bonderizing, and then subjected to dry wire drawing. First, in wire drawing 1, wire drawing was performed under a condition of true strain >0.25 to check presence of breakage. Furthermore, wire rods with no breakage occurring in the wire drawing 1 were subjected to wire drawing under a further strict condition of true strain >0.50 to check presence of breakage. Results are shown in Tables 3-1 to 3-3.

TABLE 3-1

| Steel type No. | Wire rod No. | Diameter of wire rod mm | Hydrogen content in steel ppm | Hardness HV | $460 \times C_0^{0.1}$ | Grain diameter: Average grain diameter Dave μm | Grain diameter: Maximum grain diameter Dmax μm | $C_{max}/C_0$ | Wire drawing 1: Final wire diameter mm | Wire drawing 1: True strain | Wire drawing 1: Wire drawing result | Wire drawing 2: Final wire diameter mm | Wire drawing 2: True strain | Wire drawing 2: Wire drawing result |
|---|---|---|---|---|---|---|---|---|---|---|---|---|---|---|
| A1 | A1-1 | 12.0 | 2.63 | 383 | 418 | 6.9 | 23.5 | 1.17 | 10.0 | 0.36 | X | — | — | — |
| | A1-2 | 12.0 | 1.76 | 362 | | 7.3 | 27.4 | 1.17 | 10.0 | 0.36 | ○ | 9.0 | 0.58 | ○ |
| | A1-3 | 12.0 | 0.53 | 393 | | 7.0 | 25.0 | 1.17 | 10.0 | 0.36 | ○ | 9.0 | 0.58 | ○ |
| | A1-4 | 12.0 | 0.88 | 432 | | 5.3 | 16.8 | 1.17 | 10.0 | 0.36 | X | — | — | — |
| | A1-5 | 16.0 | 2.21 | 349 | | 7.3 | 39.0 | 0.98 | 13.0 | 0.42 | ○ | 12.0 | 0.58 | ○ |
| | A1-6 | 16.0 | 1.11 | 351 | | 7.0 | 37.8 | 0.98 | 13.0 | 0.42 | ○ | 12.0 | 0.58 | ○ |
| | A1-7 | 16.0 | 0.90 | 343 | | 7.9 | 41.3 | 0.98 | 13.0 | 0.42 | ○ | 12.0 | 0.58 | ○ |
| | A1-8 | 18.0 | 1.06 | 331 | | 10.7 | 58.9 | 0.98 | 14.5 | 0.43 | ○ | 13.5 | 0.58 | ○ |
| A2 | A2-1 | 15.0 | 0.40 | 292 | 420 | 13.5 | 48.5 | 1.03 | 12.0 | 0.45 | ○ | 11.0 | 0.62 | ○ |
| A3 | A3-1 | 15.0 | 0.33 | 300 | 422 | 15.2 | 50.3 | 1.05 | 12.0 | 0.45 | ○ | 11.0 | 0.62 | ○ |
| A4 | A4-1 | 16.0 | 2.56 | 425 | 424 | 6.2 | 16.9 | 1.24 | 13.0 | 0.42 | X | — | — | — |
| | A4-2 | 16.0 | 2.42 | 341 | | 8.2 | 38.5 | 1.24 | 13.0 | 0.42 | ○ | 12.0 | 0.58 | X |
| | A4-3 | 16.0 | 2.26 | 350 | | 8.0 | 39.0 | 1.24 | 13.0 | 0.42 | ○ | 12.0 | 0.58 | X |
| | A4-4 | 16.0 | 1.23 | 409 | | 6.8 | 20.5 | 1.24 | 13.0 | 0.42 | ○ | 12.0 | 0.58 | X |
| | A4-5 | 11.5 | 1.12 | 303 | | 24.3 | 88.3 | 1.10 | 10.0 | 0.28 | ○ | 8.5 | 0.60 | X |
| | A4-6 | 11.5 | 1.70 | 355 | | 6.4 | 22.5 | 1.10 | 10.0 | 0.28 | ○ | 8.0 | 0.73 | ○ |

Wire drawing result
○: no breakage,
X: breakage

TABLE 3-2

| Steel type No. | Wire rod No. | Diameter of wire rod mm | Hydrogen content in steel ppm | Hardness HV | $460 \times C_0^{0.1}$ | Grain diameter: Average grain diameter Dave μm | Grain diameter: Maximum grain diameter Dmax μm | $C_{max}/C_0$ | Wire drawing 1: Final wire diameter mm | Wire drawing 1: True strain | Wire drawing 1: Wire drawing result | Wire drawing 2: Final wire diameter mm | Wire drawing 2: True strain | Wire drawing 2: Wire drawing result |
|---|---|---|---|---|---|---|---|---|---|---|---|---|---|---|
| A5 | A5-1 | 15.5 | 2.68 | 432 | 427 | 5.8 | 12.1 | 1.07 | 13.0 | 0.35 | X | — | — | — |
| | A5-2 | 15.5 | 2.53 | 430 | | 6.5 | 12.7 | 1.07 | 13.0 | 0.35 | X | — | — | — |
| | A5-3 | 15.5 | 2.20 | 349 | | 17.0 | 81.0 | 1.07 | 13.0 | 0.35 | ○ | 11.5 | 0.60 | X |
| | A5-4 | 15.5 | 1.75 | 346 | | 8.1 | 42.2 | 1.07 | 13.0 | 0.35 | ○ | 11.5 | 0.60 | ○ |
| | A5-5 | 15.5 | 1.21 | 337 | | 10.5 | 52.0 | 1.07 | 13.0 | 0.35 | ○ | 11.5 | 0.60 | ○ |
| A6 | A6-1 | 15.5 | 2.68 | 359 | 429 | 7.2 | 21.4 | 1.01 | 13.0 | 0.35 | X | — | — | — |
| | A6-2 | 15.5 | 1.07 | 367 | | 7.0 | 27.4 | 1.01 | 13.0 | 0.35 | ○ | 11.5 | 0.60 | ○ |
| A7 | A7-1 | 15.5 | 2.71 | 393 | 429 | 7.1 | 23.4 | 1.11 | 1.30 | 0.35 | X | — | — | — |
| | A7-2 | 15.5 | 1.22 | 412 | | 7.5 | 18.2 | 1.11 | 13.0 | 0.35 | X | — | — | — |
| A8 | A8-1 | 14.5 | 2.61 | 352 | 429 | 12.6 | 61.0 | 1.05 | 12.0 | 0.38 | X | — | — | — |
| | A8-2 | 14.5 | 0.41 | 341 | | 13.5 | 63.9 | 1.05 | 12.0 | 0.38 | ○ | 11.0 | 0.55 | ○ |
| A9 | A9-1 | 14.5 | 2.59 | 355 | 429 | 14.0 | 58.4 | 1.10 | 12.0 | 0.38 | X | — | — | — |
| | A9-2 | 14.5 | 0.68 | 362 | | 15.4 | 58.0 | 1.10 | 12.0 | 0.38 | ○ | 11.0 | 0.55 | ○ |
| A10 | A10-1 | 14.0 | 0.52 | 352 | 430 | 8.0 | 53.1 | 1.02 | 12.0 | 0.31 | ○ | 10.0 | 0.67 | ○ |
| A11 | A11-1 | 14.0 | 0.63 | 358 | 431 | 8.5 | 53.7 | 1.02 | 12.0 | 0.31 | ○ | 10.0 | 0.67 | ○ |

TABLE 3-3

| Steel type No. | Wire rod No. | Diameter of wire rod mm | Hydrogen content in steel ppm | Hardness HV | $460 \times C_0^{0.1}$ | Grain diameter: Average grain diameter Dave μm | Grain diameter: Maximum grain diameter Dmax μm | $C_{max}/C_0$ | Wire drawing 1: Final wire diameter mm | Wire drawing 1: True strain | Wire drawing 1: Wire drawing result | Wire drawing 2: Final wire diameter mm | Wire drawing 2: True strain | Wire drawing 2: Wire drawing result |
|---|---|---|---|---|---|---|---|---|---|---|---|---|---|---|
| A12 | A10-1 | 13.0 | 0.42 | 343 | 433 | 9.2 | 59.1 | 1.05 | 11.0 | 0.33 | ○ | 10.0 | 0.52 | ○ |
| A13 | A13-1 | 15.0 | 0.34 | 329 | 433 | 9.8 | 50.2 | 1.08 | 13.0 | 0.29 | ○ | 11.5 | 0.53 | ○ |
| | A13-2 | 15.0 | 0.45 | 350 | | 7.7 | 39.4 | 1.08 | 13.0 | 0.29 | ○ | 11.5 | 0.53 | ○ |
| | A13-3 | 15.0 | 0.50 | 402 | | 5.3 | 30.3 | 1.08 | 13.0 | 0.29 | ○ | 11.5 | 0.53 | ○ |

TABLE 3-3-continued

| Steel type No. | Wire rod No. | Diameter of wire rod mm | Hydrogen content in steel ppm | Hardness HV | $460 \times C_0^{0.1}$ | Grain diameter: Average grain diameter Dave μm | Grain diameter: Maximum grain diameter Dmax μm | $C_{max}/C_0$ | Wire drawing 1: Final wire diameter mm | Wire drawing 1: True strain | Wire drawing 1: Wire drawing result | Wire drawing 2: Final wire diameter mm | Wire drawing 2: True strain | Wire drawing 2: Wire drawing result |
|---|---|---|---|---|---|---|---|---|---|---|---|---|---|---|
| A14 | A14-1 | 13.0 | 0.29 | 346 | 435 | 7.6 | 48.9 | 1.05 | 11.0 | 0.33 | ○ | 10.0 | 0.52 | ○ |
| A15 | A15-1 | 13.0 | 0.44 | 359 | 436 | 7.0 | 47.7 | 1.04 | 11.0 | 0.33 | X | — | — | — |
| A16 | A16-1 | 13.0 | 0.48 | 373 | 438 | 8.1 | 42.0 | 1.04 | 11.0 | 0.33 | X | — | — | — |
| A17 | A17-1 | 12.5 | 2.72 | 359 | 438 | 8.5 | 30.9 | 1.12 | 11.0 | 0.26 | X | — | — | — |
| | A17-2 | 12.5 | 2.52 | 372 | | 8.3 | 31.3 | 1.12 | 11.0 | 0.26 | X | — | — | — |
| | A17-3 | 12.5 | 1.43 | 360 | | 8.0 | 35.2 | 1.12 | 11.0 | 0.26 | ○ | 9.0 | 0.66 | ○ |
| | A17-4 | 13.0 | 1.33 | 449 | | 8.5 | 16.7 | 1.12 | 11.0 | 0.33 | X | — | — | — |
| | A17-5 | 13.0 | 0.50 | 407 | | 9.1 | 25.3 | 1.12 | 11.0 | 0.33 | ○ | 9.5 | 0.63 | ○ |
| | A17-6 | 13.0 | 0.17 | 392 | | 8.3 | 30.1 | 1.12 | 11.0 | 0.33 | ○ | 9.5 | 0.63 | ○ |
| | A17-7 | 13.0 | 0.01 | 331 | | 7.8 | 38.6 | 1.12 | 11.0 | 0.33 | ○ | 9.5 | 0.63 | ○ |
| A18 | A18-1 | 13.0 | 0.08 | 350 | 439 | 7.0 | 33.8 | 1.12 | 11.0 | 0.33 | ○ | 9.5 | 0.63 | ○ |
| A19 | A19-1 | 8.0 | 0.54 | 370 | 444 | 8.8 | 30.5 | 1.40 | 7.0 | 0.27 | X | — | — | — |
| A20 | A20-1 | 8.0 | 0.60 | 382 | 450 | 8.0 | 50.1 | 1.04 | 7.0 | 0.27 | X | — | — | — |

Wire drawing result
○: no breakage,
X: breakage

From the results shown in Tables 3-1 to 3-3, while breakage occurred even in the wire drawing 1 under easy conditions in wire rods that does not satisfy one of the requirements of the component, the content of hydrogen in steel, and hardness specified in the embodiment of the invention; however, breakage did not occur in the wire drawing 1 in wire rods that satisfy all of such requirements. Furthermore, among the wire rods of the embodiment of the invention, in wire rods that satisfy the requirements of grain diameter ($D_{ave}$ and $D_{max}$) and segregation of C ($C_{max}/C_0$), breakage did not occur even in the wire drawing 2 under strict conditions.

The invention claimed is:

1. A hot-rolled wire rod, comprising

Fe; and, based on percent by mass:

C: 0.35 to 0.65%;

Si: 1.6 to 3.0%;

Mn: 0.10 to 1.0%;

Cr: 0.1 to 2.0%;

P: a positive amount of 0.025% or less;

S: a positive amount of 0.025% or less;

N: a positive amount of 0.006% or less;

Al: a positive amount of 0.1% or less;

O: a positive amount of 0.0030% or less; and at least one selected from the group consisting of Mg: 0.1 to 50 ppm; and Ca: 0.1 to 50 ppm;

optionally at least one selected from the group consisting of Ni: a positive amount of 1% or less and Cu: a positive amount of 1.0% or less, optionally at least one selected from the group consisting of V: a positive amount of 0.30% or less; Ti: a positive amount of 0.10% or less; Nb: a positive amount of 0.1% or less; and Zr: a positive amount of 0.10% or less, optionally Mo: a positive amount of 1.0% or less, optionally B: a positive amount of 50 ppm or less, and optionally at least one rare earth element: a positive amount of 1.5 ppm or less, wherein the rod has a wire diameter of 9.0 to 25 mm, breakage of the rod does not occur in heavy wire drawing performed under a true strain of 0.42 or more, a content of hydrogen in the rod is 2.50 ppm by mass or less, a hardness HV of the rod is $460 \times C_0^{0.1}$ or less, where $C_0$ represents a content of C measured in percent by mass in a position of depth of D/4 with D being a diameter of the rod, a maximum value of hardness in the range from 331 HV to 425 HV, and an average grain diameter $D_{ave}$ is 20 μm or less, and a maximum grain diameter $D_{max}$ is 80 μm or less in a bcc-Fe grain of a metallographic structure of the rod.

2. The hot-rolled wire rod according to claim 1, satisfying:

$$C_{max}/C_0 \leq 1.20$$

wherein $C_{max}$ represents a content of C measured in percent by mass in a position of depth of D/2.

3. The hot-rolled wire rod according to claim 1, wherein the hot-rolled wire rod is obtained by a process comprising heat treating a billet at a temperature of from 500 to 730° C. for 60 min or more prior to hot rolling the billet, and the billet has a composition comprising Fe; and, based on percent by mass:

C: 0.35 to 0.65%;

Si: 1.6 to 3.0%;

Mn: 0.10 to 1.0%;

Cr: 0.1 to 2.0%;

P: a positive amount of 0.025% or less;

S: a positive amount of 0.025% or less;

N: a positive amount of 0.006% or less;

Al: a positive amount of 0.1% or less;

O: a positive amount of 0.0030% or less; and at least one selected from the group consisting of Mg: 0.1 to 50 ppm; and Ca: 0.1 to 50 ppm;

optionally at least one selected from the group consisting of Ni: a positive amount of 1% or less and Cu: a positive amount of 1.0% or less, optionally at least one selected from the group consisting of V: a positive amount of 0.30% or less; Ti: a positive amount of 0.10% or less; Nb: a positive amount of 0.1% or less; and Zr: a positive amount of 0.10% or less, optionally Mo: a positive amount of 1.0% or less, optionally B: a positive amount of 50 ppm or less, and optionally at least one rare earth element: a positive amount of 1.5 ppm or less.

4. The hot-rolled wire rod according to claim 1, wherein the hot-rolled wire rod is obtained by a process comprising performing a homogenizing treatment in which a billet is held at 1250 to 1350° C. for 60 min, and the billet has a composition comprising Fe; and, based on percent by mass:
C: 0.35 to 0.65%;
Si: 1.6 to 3.0%;
Mn: 0.10 to 1.0%;
Cr: 0.1 to 2.0%;
P: a positive amount of 0.025% or less;
S: a positive amount of 0.025% or less;
N: a positive amount of 0.006% or less;
Al: a positive amount of 0.1% or less;
O: a positive amount of 0.0030% or less; and
at least one selected from the group consisting of Mg: 0.1 to 50 ppm; and Ca: 0.1 to 50 ppm;
optionally at least one selected from the group consisting of Ni: a positive amount of 1% or less and Cu: a positive amount of 1.0% or less,
optionally at least one selected from the group consisting of V: a positive amount of 0.30% or less; Ti: a positive amount of 0.10% or less; Nb: a positive amount of 0.1% or less; and Zr: a positive amount of 0.10% or less,
optionally Mo: a positive amount of 1.0% or less,
optionally B: a positive amount of 50 ppm or less, and
optionally at least one rare earth element: a positive amount of 1.5 ppm or less.

5. The hot-rolled wire rod according to claim 1, comprising from 0.35 to 0.44% of C.

6. The hot-rolled wire rod according to claim 1, wherein the maximum value of hardness is in the range from 331 HV to 420 HV.

7. The hot-rolled wire rod according to claim 1, wherein the rod has a wire diameter of 10.0 to 18 mm.

8. The hot-rolled wire rod according to claim 1, wherein the hot-rolled wire rod is obtained by a process comprising:
heat treating a billet at a temperature of from 500 to 730° C. for 60 min or more prior to hot rolling the billet to obtain the hot-rolled rod,
wherein the billet has a composition comprising Fe; and, based on percent by mass:
C: 0.35 to 0.65%;
Si: 1.6 to 3.0%;
Mn: 0.10 to 1.0%;
Cr: 0.1 to 2.0%;
P: a positive amount of 0.025% or less;
S: a positive amount of 0.025% or less;
N: a positive amount of 0.006% or less;
Al: a positive amount of 0.1% or less; and
O: a positive amount of 0.0030% or less; and
at least one selected from the group consisting of Mg: 0.1 to 50 ppm; and Ca: 0.1 to 50 ppm;
optionally at least one selected from the group consisting of Ni: a positive amount of 1% or less and Cu: a positive amount of 1.0% or less,
optionally at least one selected from the group consisting of V: a positive amount of 0.30% or less; Ti: a positive amount of 0.10% or less; Nb: a positive amount of 0.1% or less; and Zr: a positive amount of 0.10% or less,
optionally Mo: a positive amount of 1.0% or less,
optionally B: a positive amount of 50 ppm or less, and
optionally at least one rare earth element: a positive amount of 1.5 ppm or less;
placing the hot-rolled rod on a cooling bed at a coiling temperature TL of 1020° C. or less to obtain a wire; and
cooling the wire at an average cooling rate CR1 of 2° C./sec or more from the coiling temperature TL to 730° C., and at an average cooling rate CR2 of 5° C./sec or less from the coiling temperature TL to 500° C.

9. The hot-rolled wire rod according to claim 1, wherein the average grain diameter $D_{ave}$ is in a range of from 5.3 to 20 μm.

10. The hot-rolled wire rod according to claim 1, comprising Cr: 0.54 to 2.0%.

11. The hot-rolled wire rod according to claim 1, comprising Cr: 0.70 to 2.0%.

* * * * *